313-414 SR
8/12/86 OR 4,605,880

United States Patent [19]
McCandless et al.

[11] Patent Number: 4,605,880
[45] Date of Patent: Aug. 12, 1986

[54] MULTIBEAM ELECTRON GUN HAVING A CATHODE-GRID SUBASSEMBLY AND METHOD OF ASSEMBLING SAME

[75] Inventors: Harry E. McCandless; Sigmund T. Villanyi, both of Lancaster, Pa.

[73] Assignee: RCA Corporation, Princeton, N.J.

[21] Appl. No.: 643,175

[22] Filed: Aug. 22, 1984

[51] Int. Cl.[4] ..... H01J 29/46; H01J 29/50
[52] U.S. Cl. ..... 313/414; 313/447; 445/34
[58] Field of Search ..... 313/409, 414, 417, 444, 313/446, 447, 448, 456, 457; 445/34, 36, 67

[56] References Cited

U.S. PATENT DOCUMENTS

| | | | |
|---|---|---|---|
| 2,436,264 | 2/1948 | O'Larte et al. | 445/34 X |
| 2,859,371 | 11/1958 | Watson et al. | 313/244 |
| 3,396,297 | 8/1968 | Burdick | 313/70 |
| 3,500,520 | 3/1970 | Oess | 29/25.16 |
| 3,507,020 | 4/1970 | Aiken | 29/25.16 |
| 3,524,235 | 8/1970 | Burdick | 29/25.16 |
| 3,530,560 | 9/1970 | Sawagata | 29/25.19 |
| 3,581,357 | 6/1971 | Oess | 29/25.16 |
| 3,604,973 | 9/1971 | Doggett et al. | 313/260 |
| 3,643,121 | 2/1972 | Sawagata et al. | 313/70 |
| 3,702,020 | 11/1972 | Say | 29/25.19 |
| 3,777,210 | 12/1973 | Spalding | 313/256 |
| 3,906,279 | 9/1975 | Linssen | 313/409 |
| 4,298,818 | 11/1981 | McCandless | 313/417 |
| 4,500,808 | 2/1985 | McCandless | 313/409 |

*Primary Examiner*—David K. Moore
*Assistant Examiner*—K. Wieder
*Attorney, Agent, or Firm*—Eugene M. Whitacre; Dennis H. Irlbeck; Vincent J. Coughlin, Jr.

[57] ABSTRACT

A multibeam electron gun comprises two spaced successive electrodes individually held in position from a common electrically-insulating support. One electrode comprises a single metal plate having at least three electron-beam defining first apertures therein. The other electrode is a composite structure comprising a support plate and a second metal plate having at least three electron-beam-defining second apertures therein. Each of the first and second plates includes substantially triangularly-shaped alignment apertures which are mutually aligned so that the beam-defining apertures are aligned along common axes.

5 Claims, 15 Drawing Figures

MULTIBEAM ELECTRON GUN HAVING A CATHODE-GRID SUBASSEMBLY AND METHOD OF ASSEMBLING SAME

BACKGROUND OF THE INVENTION

This invention relates to a novel multibeam electron gun having a cathode-grid subassembly and to a novel method for assembling that electron gun.

U.S. Pat. No. 4,298,818, issued to H. E. McCandless on Nov. 3, 1981, describes an electron gun for use in a multibeam cathode-ray tube. That gun includes at least two spaced successive electrodes held in position from a common support. Each electrode comprises a single metal plate having three beam-defining apertures therein, which apertures are so aligned as to permit the passage of three electron beams. The sizes and shapes of the electron beams are determined, in part, by the sizes, shapes and alignments of the apertures.

When there are three or more beam-defining apertures in each of two spaced single-plate electrodes, it is the practice to align the apertures of the electrodes, either optically or mechanically, from two of the beam-defining apertures of each of the electrodes. While the positioning of the apertures in each electrode are precisely prescribed, nevertheless there are necessary manufacturing tolerances present in the fabrication of these electrodes and in the alignment pins which maintain the alignment of the beam-defining apertures during a brazing operation.

U.S. Pat. No. 4,500,808 issued to, H. E. McCandless on April 2, 1982, describes an electron gun and method of assembly in which one of the electrodes is a composite structure comprising a support member and a plurality of plate members. The plate members, each of which has a single beam-defining second aperture, are separately aligned to one of the first apertures in the other electrode by means of alignment pins extending through each of the first and second beam-defining apertures. The plate members are brazed to the support member to maintain the precise alignment between the first and second apertures. The manufacturing cost of such a structure is relatively high, since a larger number of accurately dimensioned electron gun components and precision alignment pins are required than in the aforedescribed patented structure. Furthermore, it is desirable to avoid using alignment pins through the beam-defining apertures of the electron gun electrodes, since the pins may distort or scratch the material surrounding the apertures, thereby causing uncontrolled variations in electron beam size and shape.

SUMMARY OF THE INVENTION

The novel gun comprises, as in prior guns, at least two spaced successive electrodes held in position from a common electrically-insulating support. Each of the electrodes has at least three beam-defining apertures aligned along common axes with beam-defining apertures in the other electrode. One of the electrodes comprises a single metal first plate having a plurality of precisely spaced beam-defining first apertures. The other electrode is a composite structure comprising a metal support plate having a plurality of windows opposite the beam-defining first apertures and a metal second plate having a plurality of precisely spaced beam-defining second apertures. Unlike prior guns, the common support and the metal support plate each have a pair of reference apertures therein, and the metal first electrode and the metal second plate each have a pair of polygonal-shaped alignment apertures therein. The polygonal-shaped alignment apertures are mutually aligned with one another and with the aforementioned reference apertures so as to align the beam-defining apertures along common axes.

The novel method is similar to prior methods except that instead of placing alignment pins through the beam-defining apertures of the electrodes, separate polygonal-shaped alignment apertures in the metal second plate are mutually aligned with the polygonal-shaped alignment apertures in the first plate and with reference apertures in the common support and in the support plate, and the second plate is repositioned so that the beam-defining apertures are aligned along common axes.

DETAILED DESCRIPTION OF THE PREFERRED EMBODIMENT

Figure 1:
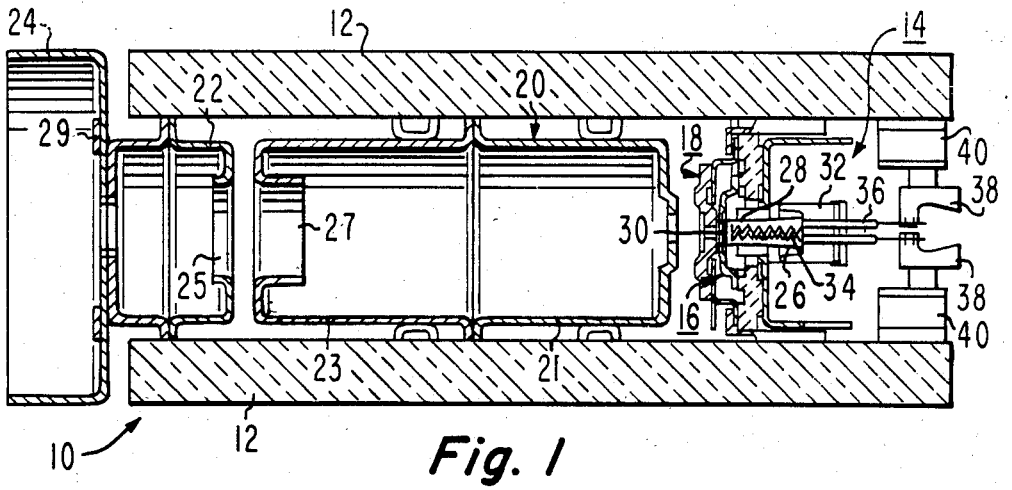
FIG. 1 is a partially cut-away, side elevational view of a preferred embodiment of the novel electron gun.

As shown in FIG. 1, an electron gun 10 comprises two glass support rods 12, also called beads, upon which various electrodes of the gun are mounted. These electrodes include three equally-spaced inline cathode assemblies 14, one for each beam, a control grid electrode 16, a screen grid electrode 18, a first focusing electrode 20, a second focusing electrode 22 and a shield cup 24 spaced from the cathode assemblies 14 in the order named.

The first focusing electrode 20 comprises two rectangularly cup-shaped members 21 and 23 joined together at their open ends. The closed ends of each member 21 and 23 have three apertures, each of which are aligned with the apertures of the control and screen grid electrodes 16 and 18. The second focusing electrode 22 is also rectangularly cup-shaped with the open end of the electrode 22 facing away from the electrode 20. Three in-line apertures also are in the electrode 22. The middle aperture 25 (FIG. 1) is aligned with the adjacent middle aperture 27 in the first electrode 20. However, the two outer apertures (not shown) are slightly offset outwardly with respect to the outer apertures of the electrode 20 to aid in convergence of the outer beams with the center beam. The shield cup 24, located at the output of the gun 10, has various coma correction members 29 located on its base around or near the electron-beam paths.

Each cathode assembly 14 comprises a cathode sleeve 26 closed at the forward end by a cap 28 having an electron emissive coating 30 thereon. The cathode sleeves 26 are supported at their open ends within cathode support tubes 32. Each cathode is indirectly heated by a heater coil 34 positioned within the sleeve 26. The heater coils 34 have legs 36 which are welded to heater straps 38 which, in turn, are welded to support studs 40 that are embedded in the glass rods 12. The control and screen grid electrodes 16 and 18 are two closely-spaced elements each having three aligned apertures about 0.625 mm (25 mils) in diameter spaced apart about 5.0 mm (200 mils) and centered with the cathode coatings 30.

Figure 2:
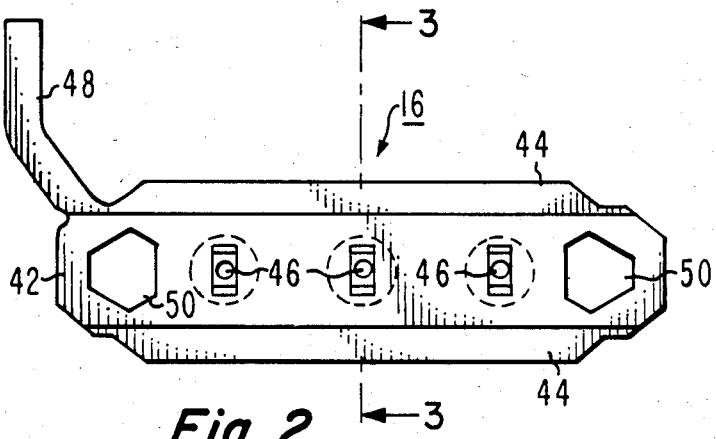
FIG. 2 is a plan view of a metal first plate of the electron gun shown in FIG. 1.
Figure 3:
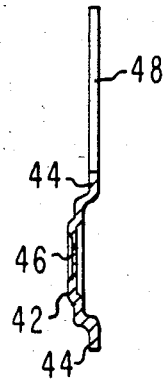
FIG. 3 is a side sectional elevational view of the metal first plate taken along line 3—3 of FIG. 2.
Figure 4:
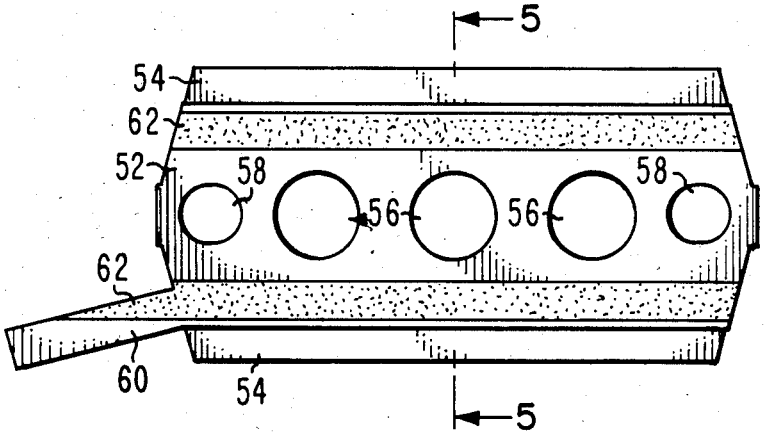
FIG. 4 is a plan view of a metal support plate of the electron gun of FIG. 1.
Figure 5:
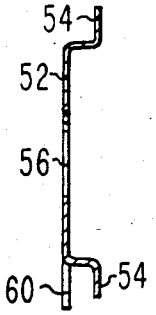
FIG. 5 is a side sectional elevational view of the metal support plate taken along lines 5—5 of FIG. 4.
Figure 6:
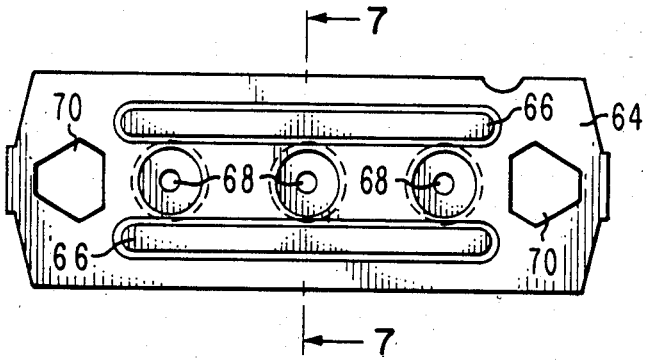
FIG. 6 is a plan view of a metal second plate of the electron gun shown in FIG. 1.
Figure 7:
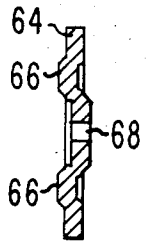
FIG. 7 is a side sectional elevational view of the metal second plate taken along line 7—7 of FIG. 6.
Figure 10:
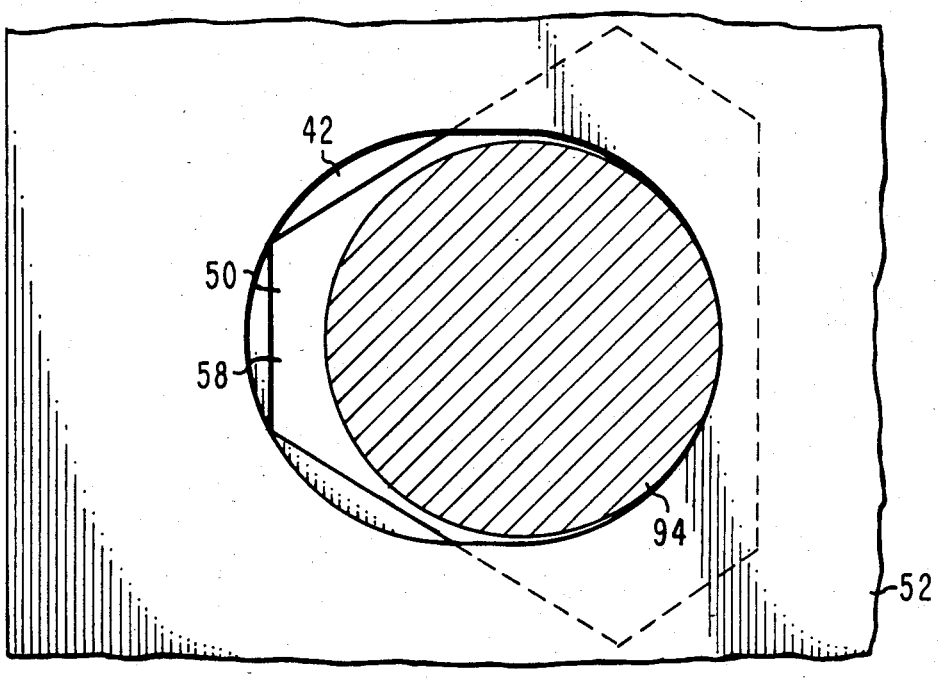
FIG. 10 is a partial sectional view taken along line 10—10 of FIG. 8.
Figure 12:
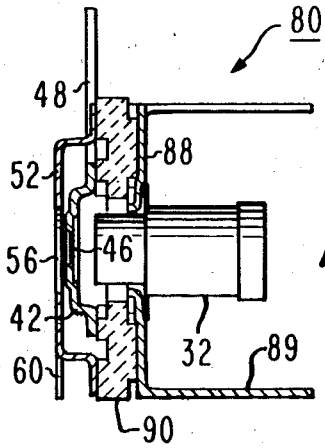
FIGS. 11 and 12 are front and side sectional elevational views of the unitary first subassembly following brazing.
Figure 11:
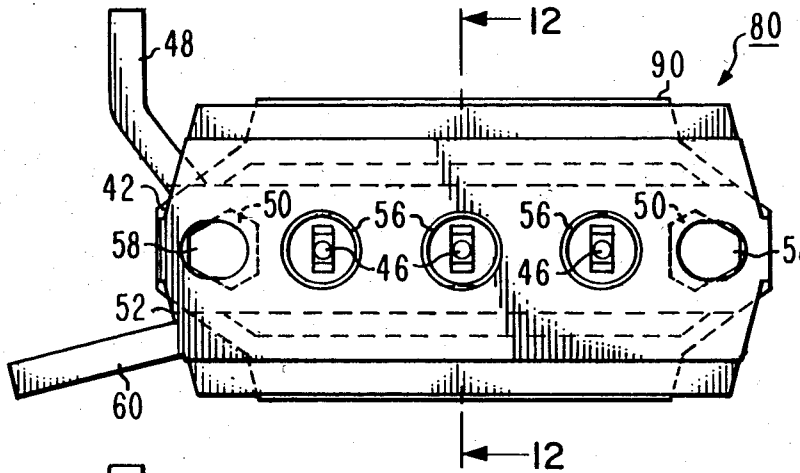

As shown in FIGS. 2 and 3, the control grid electrode 16 is essentially a single flat metal first plate 42 having two parallel flanges 44 on opposite sides of three inline precisely spaced beam-defining first apertures 46. Strips of copper are inlaid on the bottom surface (not shown) of the flanges 44. An electrical connection tab 48 extends from one end of one of the flanges 44 to facilitate electrical connection to the control grid electrode 16. A pair of novel alignment apertures 50 are formed through the first plate 42 outwardly from the beam-defining first apertures 46. The spacing from a reference point in the alignment apertures 50 to the centers of the beam-defining apertures 46 is held to an accuracy of ±0.0038 mm (0.15 mils). The structure of the screen grid electrode 18 is a composite formed from two elements. One element is essentially a flat metal support plate 52, shown in FIGS. 4 and 5, having two parallel flanges 54 on opposite sides of three inline windows 56. The windows 56 have a diameter of about 3.1 mm (124 mils) ±0.025 mm (1 mil) and are spaced apart about 5.0 mm (200 mils) ±0.025 mm (1 mil). A pair of substantially oblong or oval-shaped reference apertures 58 are formed through the support plate 52 outwardly from the windows 56. The reference apertures 58 have a major axis dimension of about 2.25 mm (90 mils) and a minor axis dimension of about 2.10 mm (84 mils). An electrical connecting tab 60 extends from one side of the support plate 52. Strips 62 of copper are inlaid in the surface of the support plate 52 on opposite sides of the windows 56 and the reference apertures 60 and also on the bottom surface (not shown) of the flanges 54. The other element of the screen grid electrode 18 is shown in FIGS. 6 and 7 and comprises an essentially flat metal second plate 64 having two parallel channels 66 formed in the body of the second plate 64 on opposite sides of three inline precisely spaced beam-defining second apertures 68. A pair of novel alignment apertures 70, substantially identical to the alignment apertures 50, are formed through the second plate 64 outwardly from the beam-defining second apertures 68. The spacing from a reference point in the alignment apertures 70 to the centers of the beam-defining second apertures 68 is held to an accuracy of ±0.0038 mm (0.15 mils). The accuracy of spacing between the alignment apertures and the beam-defining apertures in both the first plate 42 and the second plate 64 is an improvement by a factor of more than two over the precision of manufacturing tolerances discussed in U.S. Pat. No. 4,500,808 issued to McCandless, referenced above. A unitary first subassembly 80 is assembled and brazed using a jig 82, shown in FIGS. 8 and 9. The jig 82 comprises lower and upper jig members 83 and 84, respectively, and jig weight 85. Three cathode support tubes 32 are positioned in three recesses 86 in the lower jig 83. Then, a substantially annular member 88 is positioned on top of each of the support tubes 32. Each annular member 88 has an integral contact tab 89. Then, a single wafer-shaped common electrically insulating ceramic support 90 is positioned over the annular members 88. The ceramic support 90 has a hole therethrough opposite each tube 32 and annular member 88, and a pair of oblong or oval-shaped reference apertures 92 near the ends thereof. A non-precision brazing alignment pin 94, having a diameter of about 2 mm (80 mils), fits through each reference aperture 92 into a corresponding lower alignment hole 95 in the lower jig 83. The ceramic support 90 has two opposed major surfaces which are metalized so that parts can be brazed thereto. Next, first plate 42 (the control grid 16) is positioned so that the brazing alignment pins 94 pass through the novel alignment apertures 50, and the flanges 44 rest on one major surface of the ceramic support 90. The novel apertures 50 are polygonal-shaped; more particularly, each of the apertures 50 comprises an isosceles triangle with each angle truncated to form a substantially-triangularly shaped alignment aperture. The triangularly-shaped apertures 50 are oriented so that the apex of one of the angles is in line with the beam-determining inline apertures 46 of the grid 16 (see FIG. 2). Next, the oblong-shaped reference apertures 58 of the support plate 52 are disposed over the brazing alignment pins 94, and the flanges 54 rest on the one major surface of the ceramic support 90. Then, the jig weight 85 is positioned above upper jig member 84 so that jig weight pins 96 pass through weighting apertures 97 provided in upper jig 84. The jig weight pins 96 pass through the outer windows 56 in the support plate 52 and rest upon the first plate 42. As shown in FIG. 9, the upper jig 84 rests upon the flanges 54 of the support plate 52. The first subassembly 80 is then brazed in a wet hydrogen atmosphere in a BTU three-zone belt furnace at temperatures of 1105° C., 1120° C. and 1105° C. The belt speed through the furnace is four inches per minute. The alignment provided by one of the brazing alignment pins 94, extending through one of the oblong-shaped reference apertures 58 in the support plate 52 and through one of the triangularly-shaped alignment apertures 50 in the first plate 42, is shown in FIG. 10. Since the oblong-shaped reference aperture 92 in the ceramic support 90 is aligned with the corresponding oblong-shaped reference aperture 58 in the support plate 52, the former is not visible in FIG. 10. The brazed unitary first subassembly 80 is shown in FIGS. 11 and 12. At this point in the assembly process, the metal support plate 52 is attached to one major surface of the ceramic support 90, and the first plate 42 is attached to the same major surface of the ceramic support, such that the oblong-shaped reference apertures 58 in the support plate 52 are aligned with the substantially triangularly-shaped alignment apertures 50 in the first plate 42, and the windows 56 in the support plate 52 are opposite the beam-defining first apertures 46 in the first plate 42.

Figure 14:
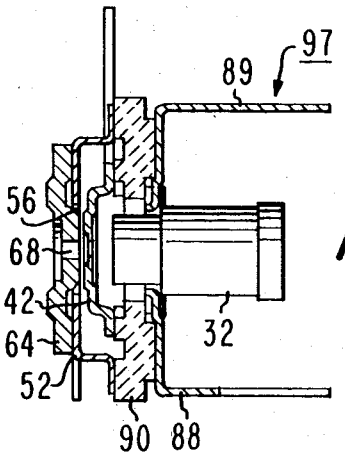
FIGS. 13 and 14 are front and side sectional elevational views of a unitary second subassembly.
Figure 13:
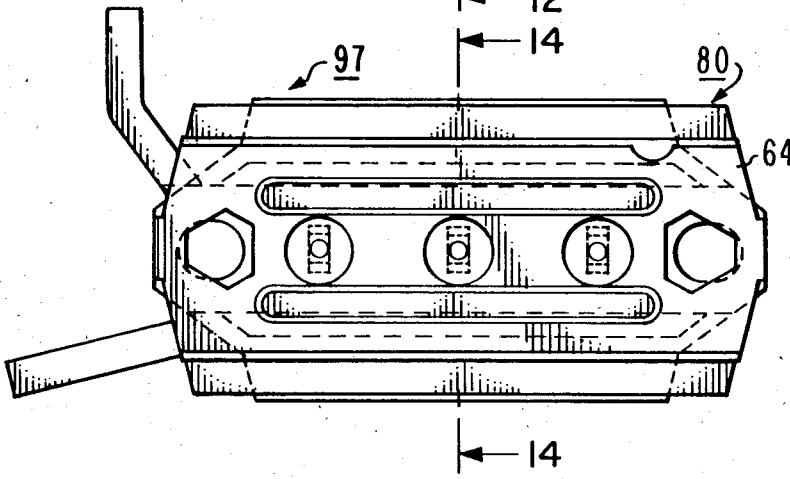
Figure 15:
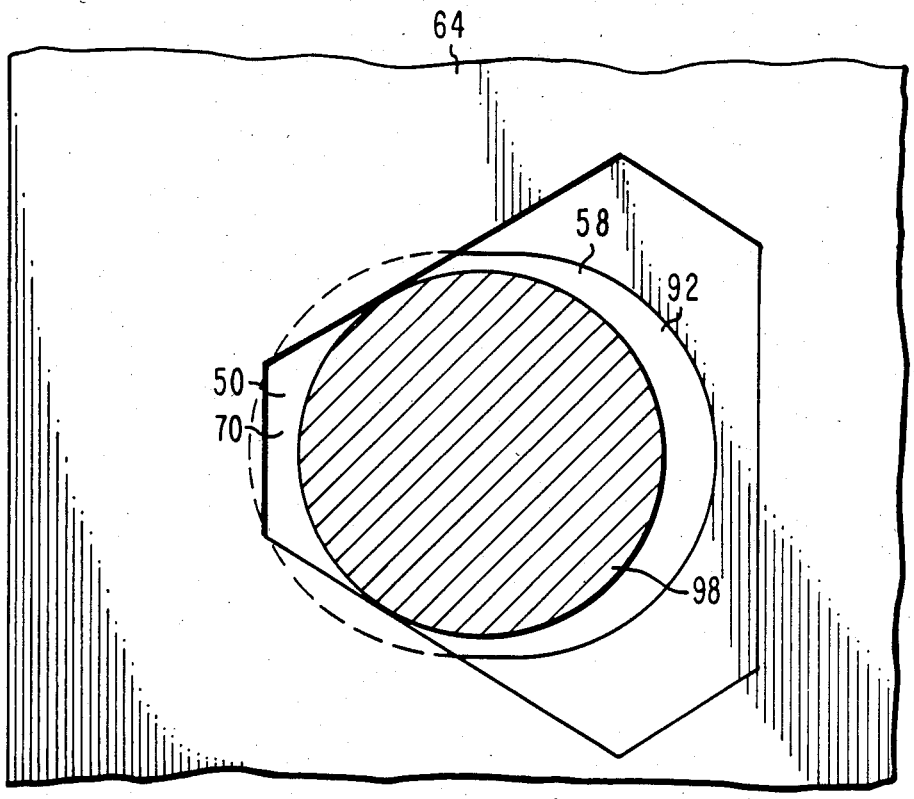
FIG. 15 is a partial sectional view of a portion of an aligned unitary second subassembly during its manufacture.

The next step in the assembly process is to form a unitary second subassembly 97, such as that shown in FIGS. 13 and 14. The first subassembly 80 is placed on a welding fixture (not shown), and the metal second plate 64 is disposed on the support plate 52, such that the beam-defining second apertures 68 are disposed within the windows 56 of the support plate 52. A pair of non-precision welding pins 98 (one of which is shown in FIG. 15) of the welding fixture are disposed through the substantially triangularly-shaped alignment apertures 70 in the second plate 64. At least one of the welding pins 98 is spring-loaded. The welding pins 98 have a diameter of about 1.875 mm (75 mils). The alignment apertures 70 in the second plate 64 are substantially identical to the triangularly-shaped alignment apertures 50 in the first plate 42. As shown in FIG. 15, the spring-loaded welding pin 98 contacts and aligns the two adjacent sides of the first and second plates 42 and 64 bordering the triangularly-shaped alignment apertures 70 and thereby mutually aligns and superimposes the triangularly-shaped alignment apertures 50 and 70 in the first and second plates 42 and 64, respectively. The oblong-shaped reference apertures 58 and 92 in the support plate 52 and the ceramic support 90 were previously aligned during the assembly and brazing of the unitary first subassembly 80. The welding pins 98 also reposition and align, along common axes, the beam-defining second apertures 68 of the second plate with the beam-defining first apertures 46 of the first plate in an indirect or secondary manner without the use of alignment pins through the beam-defining apertures 46, 68. The second plate 64 is fixed to the support plate 52 either by laser welding or resistance welding. Thus, the novel alignment structure and method permits a highly accurate means for aligning the beam-defining apertures without distorting or damaging the apertures with direct through-the-aperture precision alignment pins.

Figure 8:
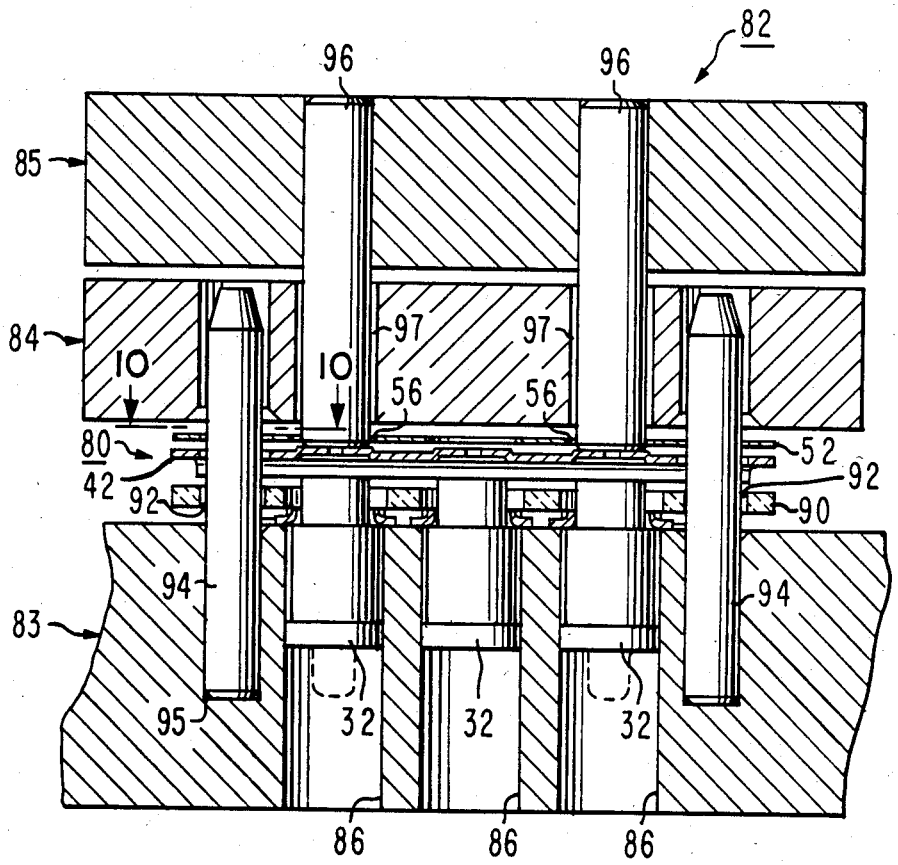
FIGS. 8 and 9 are front and side sectional elevational views of a unitary first subassembly during its manufacture.
Figure 9:
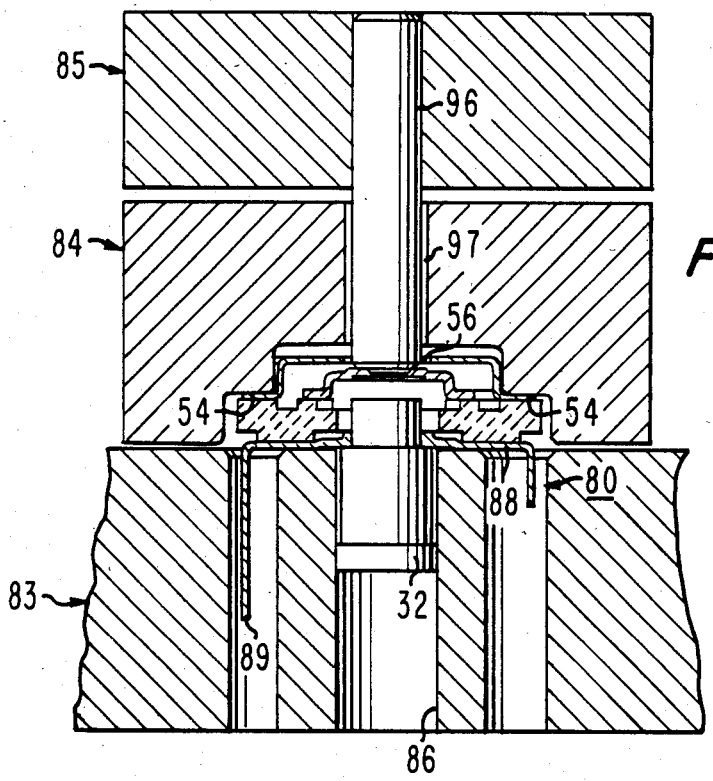

An alternative method for assembling the unitary second subassembly 97 is to use a brazing fixture similar to that shown in FIGS. 8 and 9, except that the brazing alignment pins are biased, for example, by springs, in such a manner as to be urged outwardly against the outside edges of the substantially triangularly-shaped alignment apertures 50 and 70 in the first and second plates 42 and 64, respectively. In this method, the second plate 64 is placed directly on the support plate 52, and the subassembly 97 is formed in one brazing step.

What is claimed is:

1. In a multibeam electron gun comprising at least two spaced successive electrodes held in position from a common electrically-insulating support, one of said electrodes comprising a metal first plate having at least three precisely spaced beam-defining first apertures therein, the other electrode comprising a composite structure including a metal support plate and a metal second plate, said metal support plate having at least three windows therein, said windows being disposed opposite said beam-defining first apertures, said metal second plate having at least three precisely spaced beam-defining second apertures therein, said common electrically-insulating support and said metal support plate each having a pair of reference apertures therein, said metal first plate and said metal second plate each having a pair of alignment apertures therein, wherein the improvement comprises said metal second plate being affixed to said metal support plate and having said beam-defining second apertures disposed within said windows of said metal support plate, and said pairs of alignment apertures in said metal first plate and in said metal second plate being polygonal-shaped, said metal first plate and said metal second plate having two adjacent sides bordering said polygonal-shaped alignment apertures which are mutually aligned with one another so that said polygonal-shaped alignment apertures are mutually aligned with one another and with said reference apertures in said common electrically-insulating support and in said metal support plate, whereby said beam-defining first apertures in said metal first plate and said beam defining second apertures in said metal second plate are aligned along common axes.

2. The electron gun of claim 1 wherein said common electrically-insulating support is a ceramic member having opposed major surfaces, said ceramic member having at least three openings therein, said openings being aligned along the common axes, said metal first plate and said metal support plate having said metal second plate affixed thereto being individually attached to the same major surface of said ceramic member.

3. The electron gun of claim 2 including a separate cathode assembly attached to the other major surface of said ceramic member and aligned with each pair of beam-defining first and second apertures.

4. The electron gun of claim 1 wherein said metal first plate is the control grid electrode and the metal second plate is the screen grid electrode.

5. The electron gun of claim 1 wherein said pair of alignment apertures in said metal first plate and in said metal second plate are substantially triangularly-shaped.

* * * * *